US006966852B2

(12) United States Patent
Yoon

(10) Patent No.: US 6,966,852 B2
(45) **Date of Patent: *Nov. 22, 2005**

(54) MODULAR ALL SPORTS NET ASSEMBLY

(76) Inventor: Young W. Yoon, 127 Michael Mannor, Glenview, IL (US) 60025

( * ) Notice: Subject to any disclaimer, the term of this patent is extended or adjusted under 35 U.S.C. 154(b) by 16 days.

This patent is subject to a terminal disclaimer.

(21) Appl. No.: 10/417,687

(22) Filed: Apr. 17, 2003

(65) Prior Publication Data

US 2003/0181264 A1 Sep. 25, 2003

Related U.S. Application Data

(63) Continuation-in-part of application No. 09/356,290, filed on Jul. 16, 1999, now Pat. No. 6,579,196.

(51) Int. Cl.[7] ..... A63B 69/00
(52) U.S. Cl. ..... 473/421; 478/422; 478/478
(58) Field of Search ..... 473/421, 422, 473/478, 197, 159, 492, 426, 476

(56) References Cited

U.S. PATENT DOCUMENTS

| | | | | |
|---|---|---|---|---|
| 2,922,653 A | | 1/1960 | O'Brien | |
| 3,001,795 A | | 9/1961 | Johnson, Jr. | |
| 3,195,898 A | | 7/1965 | Respini | |
| 3,347,575 A | * | 10/1967 | Morris | 403/107 |
| 3,424,178 A | | 1/1969 | Yataki | |
| 3,642,282 A | * | 2/1972 | Frischman | 473/478 |
| 3,675,667 A | | 7/1972 | Miller | |
| 3,698,712 A | | 10/1972 | Pero | |
| 3,960,161 A | | 6/1976 | Norman | |
| 3,990,463 A | | 11/1976 | Norman | |
| 4,063,739 A | | 12/1977 | La Rose | |
| 4,083,561 A | | 4/1978 | Daffer | |
| 4,523,760 A | | 6/1985 | Bednarczuk | |
| 4,556,219 A | | 12/1985 | Tillery | |
| 4,702,478 A | | 10/1987 | Kruse | |
| 4,825,892 A | | 5/1989 | Norman | |
| 4,858,634 A | | 8/1989 | McLeese | |
| 5,088,740 A | | 2/1992 | Peterson | |
| 5,163,461 A | | 11/1992 | Ivanovich et al. | |

(Continued)

FOREIGN PATENT DOCUMENTS

| | | |
|---|---|---|
| FR | 2485379 | 12/1981 |
| GB | 21909 | of 1906 |

OTHER PUBLICATIONS

"The Golfsmith Store," Holiday 1997.
"Hammacher Schlemmer," Summer 1998.
"High Street Emporium," Summer 1998.
"Golfsmith," 1998.
"Brookstone Gift Collection," Jun. 1999.
KWIKGOAL; 1999 Soccer Equipment (1998); 140 Pacific Drive, Quakertowne, PA 18951.
"The Golfsmith Store," Jul. 1999.
"Golf Day," Catalog 129C3.
"Excalibur SunScreen," Excalibur Electronics, Inc.
@gricultureonline pp. 1–3, http://www.agriculture.com/sfonline/archive/sf/aatf/march96.html, Mar. 1, 1996.
The Ohio Nut and Bolt Company pp. 1–9, http://www.on–b.com/product/weldata/wldguide.htm, May 2, 2002.

*Primary Examiner*—Gregory Vidovich
*Assistant Examiner*—M. Chambers
(74) *Attorney, Agent, or Firm*—Price, Heneveld, Cooper, DeWitt & Litton, LLP

(57) ABSTRACT

A modular sports net assembly of the type forming an enclosure and used for receiving and retaining a sports item, such as a ball or the like. The assembly is assembled for deployment as a prism of varying shapes and sizes on any relatively flat ground surface and disassembled for storage. The assembly includes a tubular interfitting frame and a plurality of planar net panels.

25 Claims, 14 Drawing Sheets

U.S. PATENT DOCUMENTS 5,249,592 A 10/1993 Springer et al.
5,337,772 A 8/1994 Habchi
5,407,178 A 4/1995 Long
5,421,586 A 6/1995 Amram et al.
5,421,666 A 6/1995 Spears
5,427,381 A 6/1995 Macaluso et al.
5,439,017 A 8/1995 Brown
5,569,094 A 10/1996 Macaluso
RE35,571 E 7/1997 McLeese
5,645,096 A 7/1997 Hazinski et al.
5,676,168 A 10/1997 Price
5,730,442 A 3/1998 Anderson
5,816,278 A 10/1998 Kim
5,842,940 A 12/1998 Macaluso
5,976,023 A 11/1999 Cho
5,989,130 A 11/1999 Macaluso
6,135,894 A 10/2000 Cho
6,579,196 B1 * 6/2003 Yoon ..... 473/421

* cited by examiner 133
122
137
135
120
144
131
122
118

133
122
137
123
120A
139
144B
138
118

133
122
137
135
130
144
131
122
118

133
122
137
123
130A
139
144B
138
118

MODULAR ALL SPORTS NET ASSEMBLY

CROSS-REFERENCE TO RELATED APPLICATION

This application is a continuation-in-part of U.S. patent application Ser. No. 09/356,290 (now U.S. Pat. No. 6,579,196), to Young W. Yoon, entitled "MODULAR ALL SPORTS NET ASSEMBLY," filed Jul. 16, 1999, now U.S. Pat. No. 6,579,196 the entire disclosure of which is hereby incorporated herein by reference in its entirety.

FIELD OF THE INVENTION

The present invention generally relates to an all sports net. In particular, the present invention relates to a modular net and frame assembly adapted to a variety of sports, the net forming an enclosure for receiving and retaining a sports item, such as a ball or the like, and the enclosure being formed into the shape of a prism. A plurality of netting panels are removably attached to a tubular frame structure to enclose the frame assembly, except for at least one open side plane.

BACKGROUND OF THE INVENTION

Nets are commonly used for a wide variety of sporting activities played on a level, open field. A representative, but certainly not exhaustive, list of such sports includes soccer, field hockey, batting and pitching practice for baseball, throwing and kicking practice for football, golf driving practice and archery practice. Unfortunately, nets for each of these sports have not been seen as interchangeable and, indeed, have, in the past, taken on different sizes and shapes.

The primary users of such nets are institutional users, such as schools, churches and leagues. However, even though these institutional users typically look for ways to save funds, they have found it necessary in the past to purchase a specific net or nets for each sport. It would therefore be advantageous for such institutional users, as well as other users, such as individuals, to be able to purchase one or just a few nets that can be adapted for use with every sport.

Unfortunately, such a universal sports net has not been readily available. Several net designs exist, including frame and net structures. These nets typically include a frame forming a periphery to which is attached a mesh or net material. Some frames comprise a set of interlocking right-angle poles that, when fully assembled, form a rectangular shape across which a screen or net is positioned and into which a sport object can be thrown or kicked. Such frames, however, are typically dedicated to a single sport, usually fairly expensive and complex to assemble, particularly alone. Other frames comprise self-erecting flexible rings that can be folded upon themselves and which are attached about their periphery to a net or mesh. Although easier to deploy, such frames likewise are dedicated to a single sport use.

SUMMARY OF THE INVENTION

To overcome these and other disadvantages of the prior art, the present invention, briefly described, provides an improved all sports net assembly for forming an enclosure for receiving and retaining a sports item, such as a ball or the like. The assembly may be readily assembled for deployment on any relatively flat ground surface and subsequently readily disassembled for storage. The assembly includes a tubular frame structure formed into the shape of a prism, such as a regular square prism. A plurality of intermediate pole segments interconnect a plurality of corner units. Each of the corner units comprise pole receiving portions extending along at least three independent axes, for example, in at least the vertical and two horizontal directions, where each pole receiving portion receives an end of an intermediate pole segment to define at least four independent flat intersecting and interconnected planes. A plurality of netting panels are removably attached to the tubular frame structure so as to enclose the tubular frame structure, except for at least one side of the tubular frame structure.

The modular all sports net assembly of the present invention can be readily assembled and disassembled, while providing a net that is very effective for use in a number of different sports, such as a goal net for soccer or field hockey or a backstop for batting or golf driving practice. The frame structure and net assembly can be readily adapted to form a regular square prism only or can be combined to form other prisms of varying shapes and sizes. In a particular embodiment of the invention, the netting is formed from individual, discrete panels that can be deployed upon the frame assembly to form a rectangle when joined with other tubular frame structures having an opening along the longer side of such a rectangle or as an enclosure with an opening on only one side to create an extended net or tunnel.

As will appear from the detailed description of the various embodiments, the features of the all sports net render it suitable for a wide variety of conditions and uses. Particularly in the case of institutions, such as schools and colleges, the flexibility and adaptability of the present invention to an almost infinite number of applications render a sports net virtually always readily available, and, therefore, offers an overall relatively inexpensive net compared to nets having a single dedicated sports application or use.

The above brief description sets forth rather broadly the more important features of the present invention so that the detailed description that follows may be better understood, and so that the present contributions to the art may be better appreciated. There are, of course, additional features of the invention that will be described hereinafter, which will form the subject matter of the claims appended hereto.

In this respect, before explaining the various embodiments in detail, it is to be understood that the invention is not limited in its application to the details of the construction and the arrangements set forth in the following description or illustrated in the drawings. The modular all sports net of the present invention is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this invention is based, may readily be used as a basis for designing other structures, methods and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

The present invention provides a modular all sports net that is readily adapted to function advantageously with a number of different sports, such as soccer and baseball. Embodiments of the present invention provide a new modular all sports net that is formed from easily manipulated pole and corner sections that are easily assembled and disassembled. A modular all sports net according to the present invention may form an enclosure for receiving and retaining a sports item, such as a ball or the like, to restrict the travel of the ball so that the ball immediately drops to the ground upon impacting the net. According to another embodiment, a modular all sports net is formed from interlocking pole and corner sections, where the poles are further collapsible for easier storage. Finally, embodiments of the present invention provide a new modular all sports net that is relatively inexpensive, robust and durable.

According to one embodiment of the present invention, a modular sports net assembly of the type forming an enclosure and used for receiving and retaining a sports item, such as a ball or the like is disclosed. The assembly is assembled for deployment as a prism of varying shapes and sizes on any relatively flat ground surface and disassembled for storage. The assembly comprises a tubular interfitting frame and a plurality of planar net panels. The frame has the shape of a polyhedron having two polygon sides in parallel planes and two sides formed in the shape of parallelograms formed from a plurality of intermediate tubular pole segments. At least a portion of the intermediate tubular pole segments interconnect a plurality of corner units to form a plurality of orthogonal edge peripheries. The corner units include projecting pole receiving portions extending along at least three independent axes, each pole receiving portion receiving an end of the at least portion of the intermediate pole segments. The frame defines at least three interconnected planes. The planar netting panels are removably attached to one side of the edge peripheries of the frame so as to enclose the frame, except for at least one side plane, when the frame assembled is deployed on a relatively flat ground surface. At least a portion of the intermediate tubular pole segments interconnecting the plurality of corner units comprises a plurality of articulating and interlocking portions having cooperating first and second mating ends. An interior diameter of the first mating end is larger than an exterior diameter of the second mating end and receives a second mating end therein to positively connect the articulating and interlocking portions. A stretchable connecting cable interconnects at least two of the articulating and interconnecting portions of the at least a portion of the intermediate tubular pole segments. The connecting cable includes a wire segment at each end thereof that includes buttons located at opposite ends that are positioned within two different ones of the articulating and interlocking portions. The buttons protrude through apertures in the two different ones of the articulating and interlocking portions to positively connect the at least two of the articulating and interlocking portions together.

These and other objects, along with the various features and structures that characterize the invention, are pointed out with particularity in the claims annexed to and forming a part of this disclosure. For a better understanding of the modular all sports net of the present invention, its advantages and the specific objects attained by its uses, reference should be had to the accompanying drawings and descriptive matter in which there are illustrated embodiments of the present invention.

While embodiments of the all sports net are herein illustrated and described, it is to be appreciated that various changes, rearrangements and modifications may be made therein, without departing from the scope of the invention, as defined by the appended claims.

BRIEF DESCRIPTION OF THE DRAWINGS

The disclosure of the modular all sports net is explained with illustrative embodiments shown in the accompanying drawing, where.

DETAILED DESCRIPTION OF THE PREFERRED EMBODIMENTS

Figure 1:
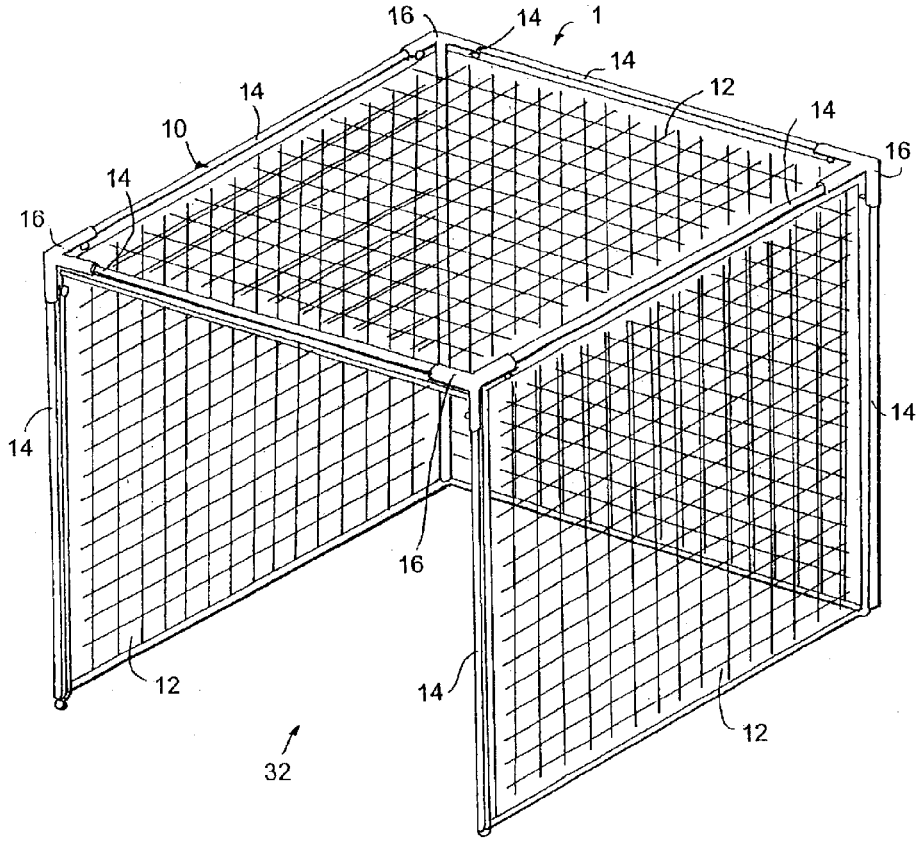
FIG. 1 is a perspective overall view of one embodiment of the present invention.

The best mode for carrying out the invention is presented in terms of the disclosed embodiments, wherein similar reference characters designate corresponding features throughout the several figures of the drawings.

Figure 7:
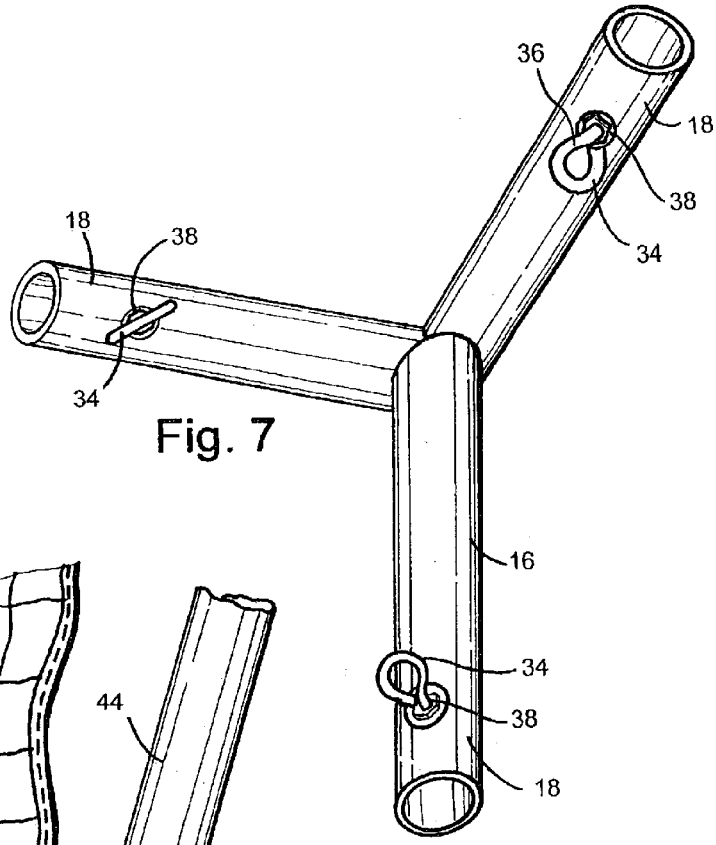
FIG. 7 is a perspective view of one embodiment of one of the corner units of the tubular frame of the present invention having orthogonally projecting pole receiving portions extending in a vertical and two horizontal directions and locking turnbuckles.
Figure 9:
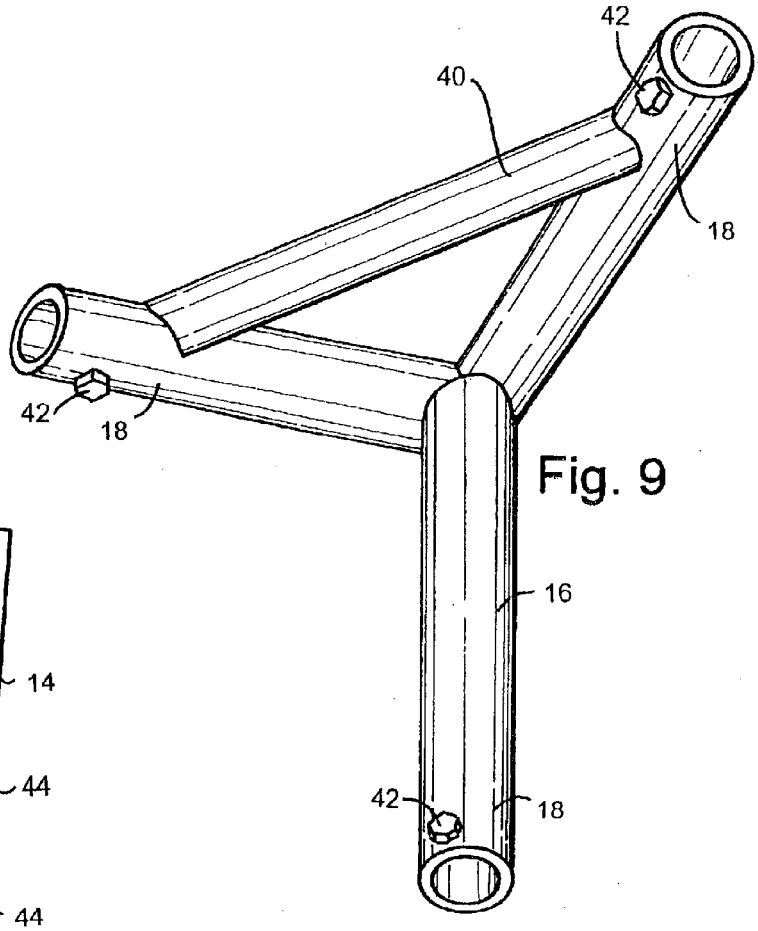
FIG. 9 is a perspective view of yet another embodiment of one of the corner units of the frame assembly of the present invention having orthogonally projecting pole receiving portions extending in a vertical and two horizontal directions, a bracing bar and locking members.
Figure 10:
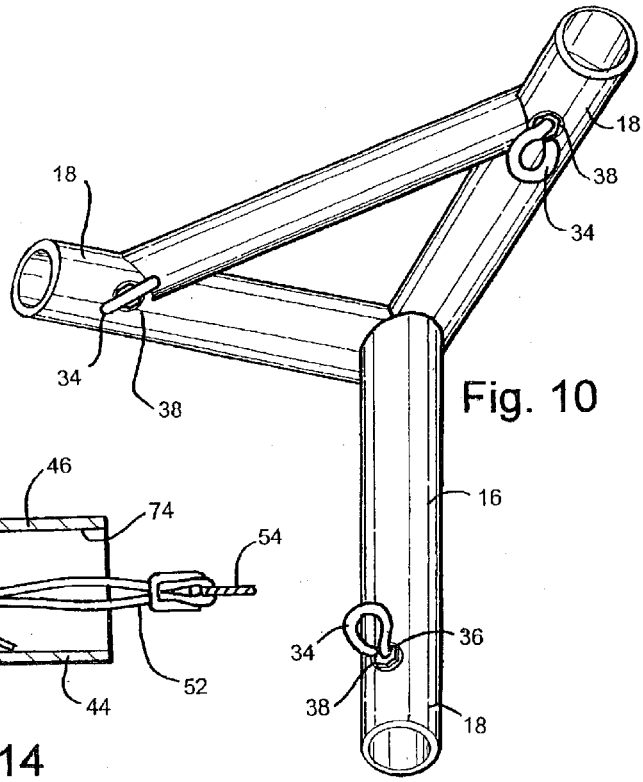
FIG. 10 is a perspective view of still another embodiment of one of the corner units of the frame assembly of the present invention having orthogonally projecting pole receiving portions extending in a vertical and two horizontal directions, a bracing bar and locking turnbuckles.

Referring now to the drawings, particularly FIG. 1, there is shown, in a perspective view, the modular all sports net assembly 1 of the present invention. The modular all sports net assembly 1 consists primarily of a tubular frame 10 and a plurality of netting panels 12. The tubular frame 10 of the present invention forms the shape of a regular prism, e.g., as a unitary square prism or cube as seen in FIG. 1. In one embodiment, as shown, the tubular frame 10 adopts the form of a regular prism, wherein the prism, as used herein, is defined as a polyhedron having two polygon sides in parallel planes and two sides formed in the shape of parallelograms. In one embodiment, the prism includes four identical and interchangeable intermediate tubular pole segments 14, each having the same length, horizontally interconnecting four upper corner units 16. Each of the corner units 16 have at least a trio of projecting pole receiving portions 18, e.g., extending orthogonally in two horizontal and one vertical depending directions, as shown in FIGS. 7, 9 and 10. Each pole receiving portion 18 of the corner unit 16 is adapted to receive one end of one of the horizontal intermediate pole segments 14, with the horizontally projecting pole receiving portions 18 cooperating with the horizontal intermediate pole segments 14 to form a flat horizontal top plane. One of four additional and identical interchangeable intermediate tubular pole segments 14, also having the same length as the horizontal pole segments 14, are received within each of the vertically depending pole receiving portions 18 of the corner unit 16 to form four flat vertical side planes and columns upon which the assembly 1 is supported.

Figure 2:
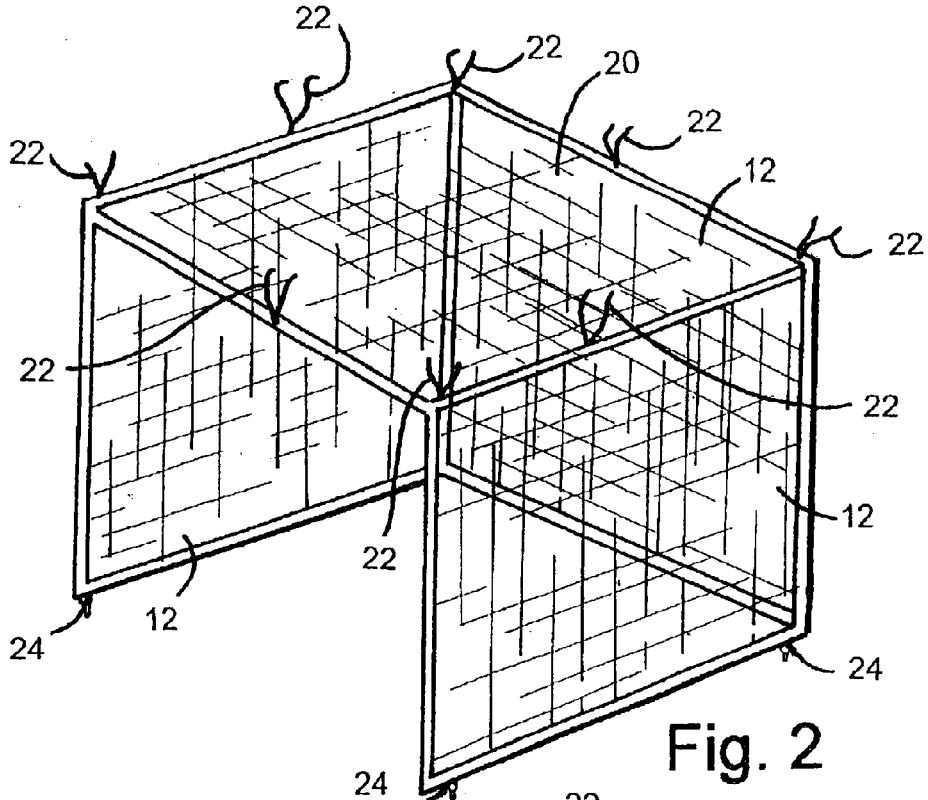
FIG. 2 is a perspective view of one embodiment of the netting panels of the present invention.
Figure 3:
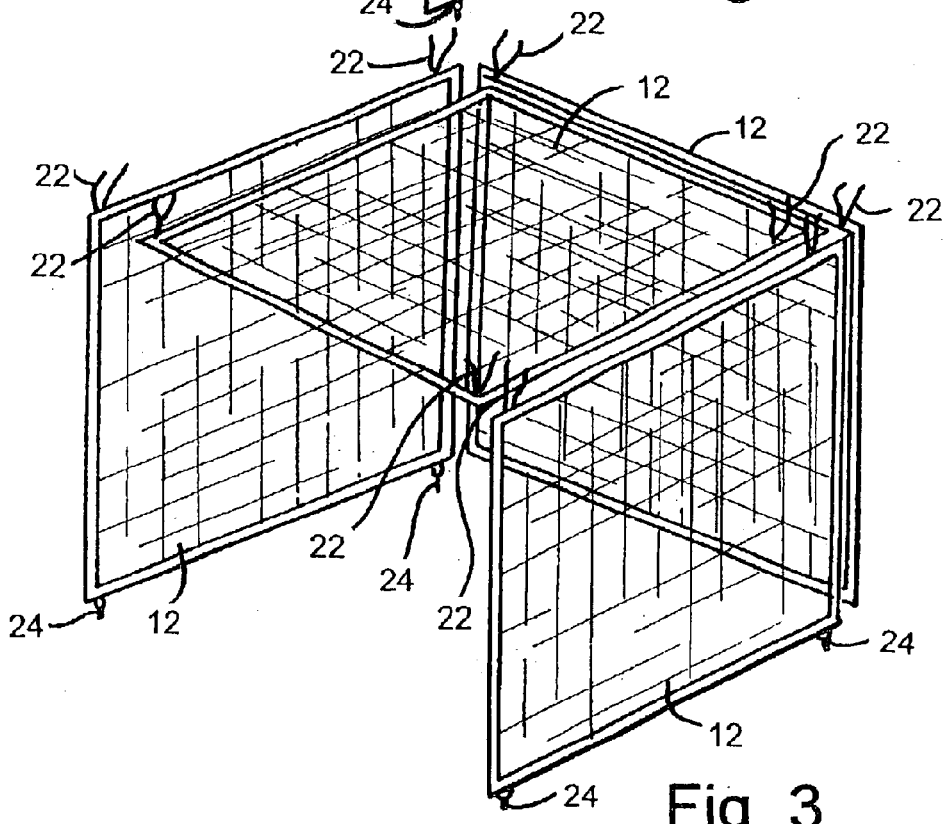
FIG. 3 is a perspective view of another embodiment of the netting panels of present invention.

The netting panels 12 are arranged so that, when attached to the tubular frame 10, the netting panels 12 may, enclose the tubular frame 10, except for one side plane of the frame 10, as seen in FIG. 1, to form an opening 32. The netting panel 12 may be formed of a mesh-type netting fabric made from any natural or synthetic fiber, such as nylon. The mesh may include openings of about 0.25 inches. The netting panels 12 may be advantageously joined about their edge peripheries to form an integral regular netting prism 20, such as shown in FIG. 2. However, the netting panels 12 can also be retained as separate panels to be individually attached to the frame 10, as shown in FIG. 3. This latter embodiment may be preferred for a number of applications, as discussed further below.

Attachment means 22, e.g., tying straps, are provided at each upper corner of the netting prism 20, as seen in FIG. 2, or the individual netting panels 12, as seen in FIG. 3. These tying straps 22 are used to tie the netting prism 20 or netting panels 12 to the tubular frame 10, either to the intermediate tubular pole segments 14 or to each of the upper corner units 16, as will be discussed below. It should be noted that several interchangeable techniques may be used to attach the upper corner of the netting prism 20 or netting panels 12 to the tubular frame 10, including hook and loop straps, hooks and snap arrangements. The exact attachment means 22 is not important, however, the attachment means 22 should be adapted for ready attachment and detachment of the upper corner of the netting prism 20 or netting panels 12 to the tubular frame 10, while also providing a relatively secure attachment that is resistant to accidental separation of the netting prism 20 or netting panels 12 from the tubular frame 10. Moreover, it is contemplated that intermediate attachment means 22, positioned between the upper corner units 16, can be provided to provide a more uniform support of the netting prism 20 or netting panel 12 along the intermediate tubular pole segments 14, as shown in FIG. 2.

Figure 6:
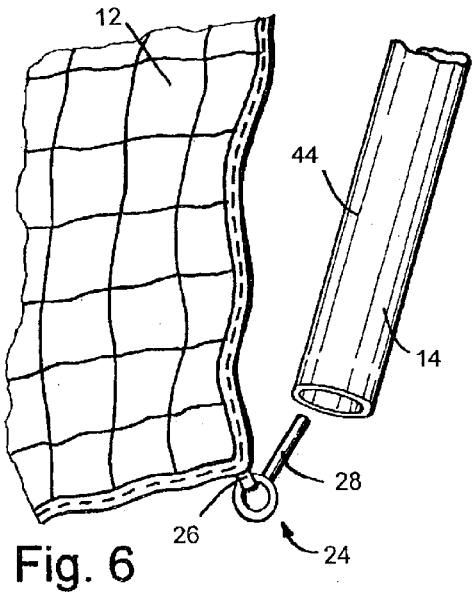
FIG. 6 is a perspective view of a lower net panel and lower vertical pole connector.

Referring to FIG. 6, there is shown in detail a lower attachment means 24 for attaching the bottom corners of the netting prism 20 or the netting panels 12 to the bottom of the intermediate segment 14 of the tubular frame 10. The lower attachment means 24 includes an elastomeric retaining strap 26 fixedly attached to the lower corner of the netting prism 20 or netting panels 12, through which is securely held a retaining pin 28. The retaining pin 28 is adapted to be inserted into a lower open end of one of the intermediate tubular pole segments 14. After the upper portion of the netting prism 20 or the netting panel 12 is secured to the upper corner unit 16 or frame 10, such that the vertical extent of the netting prism 20 or netting panel 12 can be placed in tension, the retaining strap 26 is stretched so the retaining pin 28 can be inserted in the lower open pole. Once released, the tension in the netting prism 20 or netting panel 12 and retaining strap 26 retains the lower corner to the tubular frame 10.

Again, several interchangeable lower attachment means 24 may be used to attach the lower corner of the netting prism 20 or netting panels 12 to the bottom of the intermediate segment 14, including hook and loop straps, hooks and snap arrangements. The lower attachment means 24, however, should be adapted for ready attachment and detachment of the lower corner of the netting prism 20 or netting panels 12 to the intermediate tubular pole segment 14, while also providing a relatively secure attachment that resists accidental separation of the netting prism 20 or netting panels 12 from the tubular frame 10. Although not shown, tether lines can extend from the intermediate segments 14 or the upper corner units 16 to anchor the net assembly 1 via ground stakes at locations oblique to the plane of the net assembly 1, as is shown. Alternatively, or in conjunction with tether lines, ground stakes can be inserted through the retaining pin 28 at ground level to secure the net assembly 1, but allow the net assembly 1 to be easily moved.

A first embodiment of the upper corner unit 16 is shown in FIG. 7. The corner units 16 comprise at least three projecting pole receiving portions 18, extending orthogonally in two horizontal and one vertical depending directions, best seen in FIGS. 7, 9 and 10. Each pole receiving portion 18 receives one end of one of the interchangeable intermediate pole segments 14, with the horizontally projecting pole receiving portions 18, interconnecting by the horizontal pole segments 14, forming a flat horizontal top plane. The vertically depending projecting pole receiving portion 18 of the corner unit 16 receives one of the four vertically depending and interchangeable intermediate tubular pole segments 14. The corner units 16 may be fabricated from 0.063 inches cold rolled steel tubing that is welded at the intersections to form the orthogonal shape.

Each of the pole receiving portions 18 may also include a locking turnbuckle 34 having a threaded shank 36 that is threadingly received within a cooperating nut 38 welded to the outer surface of the pole receiving portion 18. A hole, not shown, extends through the tubular pole receiving portion 18, such that, when the end of one of the interchangeable intermediate pole segments 14 is inserted into the pole receiving portion 18, the turnbuckle 34 can be rotated and tightened so as to push against one side of the intermediate pole segment 14 for a snug fit therein, thereby locking the intermediate pole segment 14 into position. In this embodiment, the tying straps 22 of the netting prism 20 or netting panels 12 can be attached to the tubular frame 10 through the turnbuckles 34.

As noted above, in one embodiment, each of the tubular pole segments 14 have the same size and length, regardless of whether used in the vertical or horizontal orientation. Thus, in this embodiment, the assembly takes on the shape of a regular square prism, or cube, where each of the tubular pole segments 14 are interchangeable with all the others, dramatically simplifying assembly.

Figure 8:
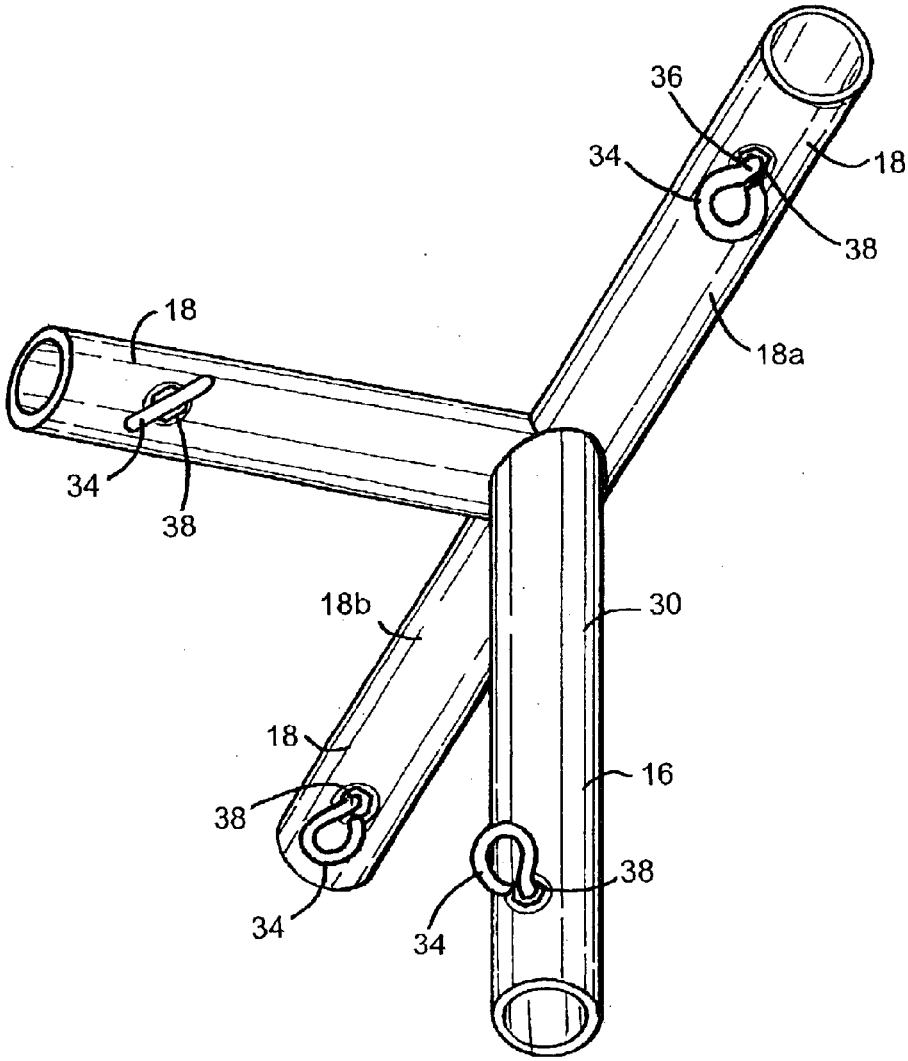
FIG. 8 is a perspective view of another embodiment of one of the corner units of the tubular frame of the present invention having orthogonally projecting pole receiving portions extending in a vertical and three horizontal directions, each of the pole receiving portions having locking turnbuckles.

A second embodiment of the upper corner unit 16 is shown in FIG. 8. There, the corner units 16 comprise three orthogonally projecting pole receiving portions 18 extending in two horizontal and one vertical depending directions, as before. However, a fourth pole receiving portion 18*b* extends in a horizontal direction opposite that of one of the two horizontally extending pole receiving portions 18*a*. This additional pole receiving portion 18*b* allows the corner unit to be transformed into an intermediate upper unit 30, which, as seen assembled in FIGS. 4 and 5, allows for elongated sport net assemblies by receiving additional intermediate pole segments 14 in the additional horizontally projecting pole receiving portions 18*b*, to form an extended flat horizontal top plane.

Figure 4:
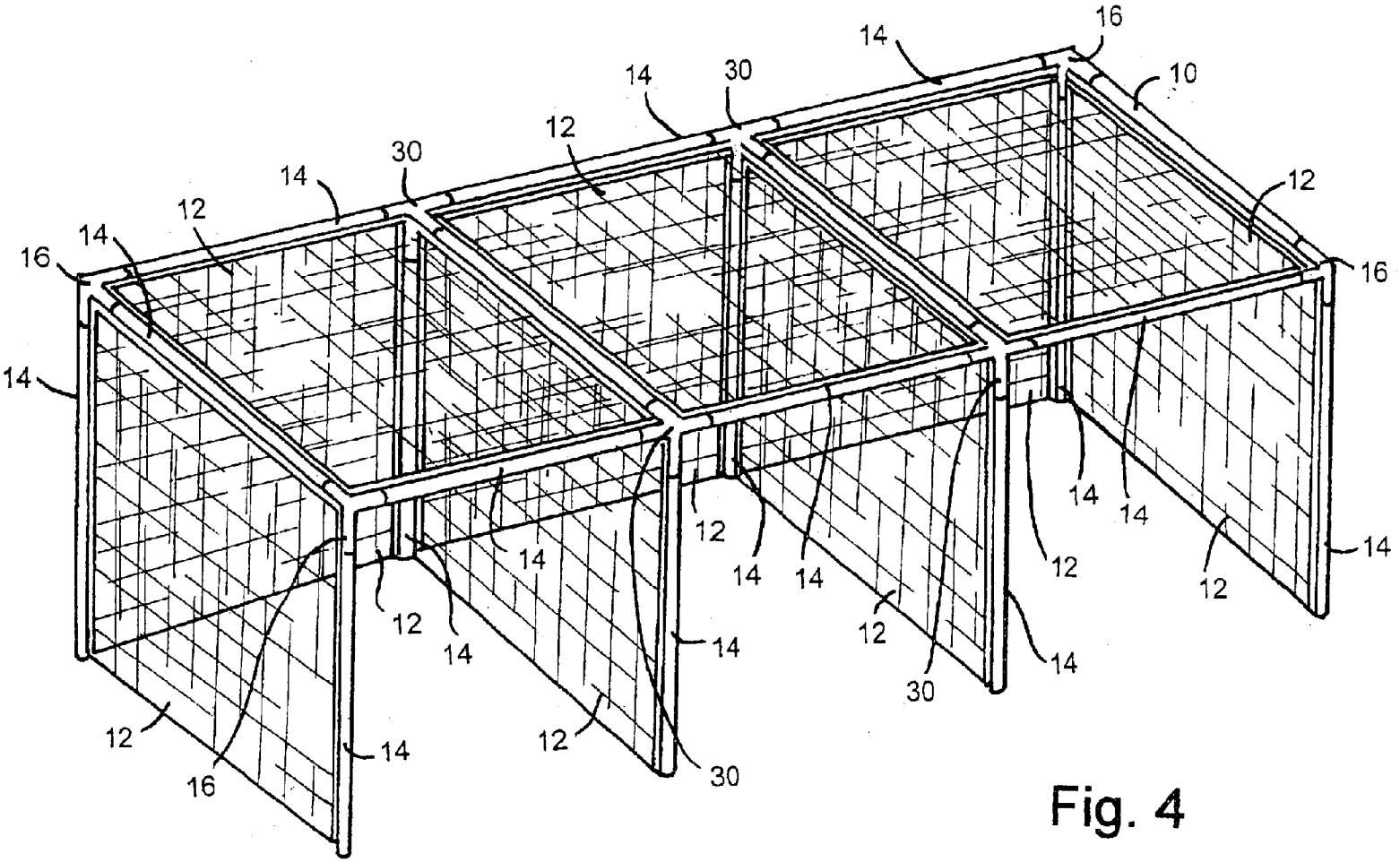
FIG. 4 is a perspective view of the all sports net of the present invention adapted to form a series of individual net cages, for example, as used in batting practice.

More particularly, shown in FIG. 4 is one of many possible adaptations of the sports net assembly of the present invention, wherein a series of openings are created along the longer length of essentially three cubic sports net assemblies 1 combined into a single assembly. The netting is formed from individual, discrete netting panels 12 attached to the tubular frame 10, forming an enclosure open on one side. Such a configuration would, for example, be especially useful in batting practice, where the players could line up in front of their respective cages or cubic net assemblies 1 created by the netting panels 12 and function substantially independently of, but simultaneously with, players standing in front of adjacent cubic net assemblies 1.

Figure 5:
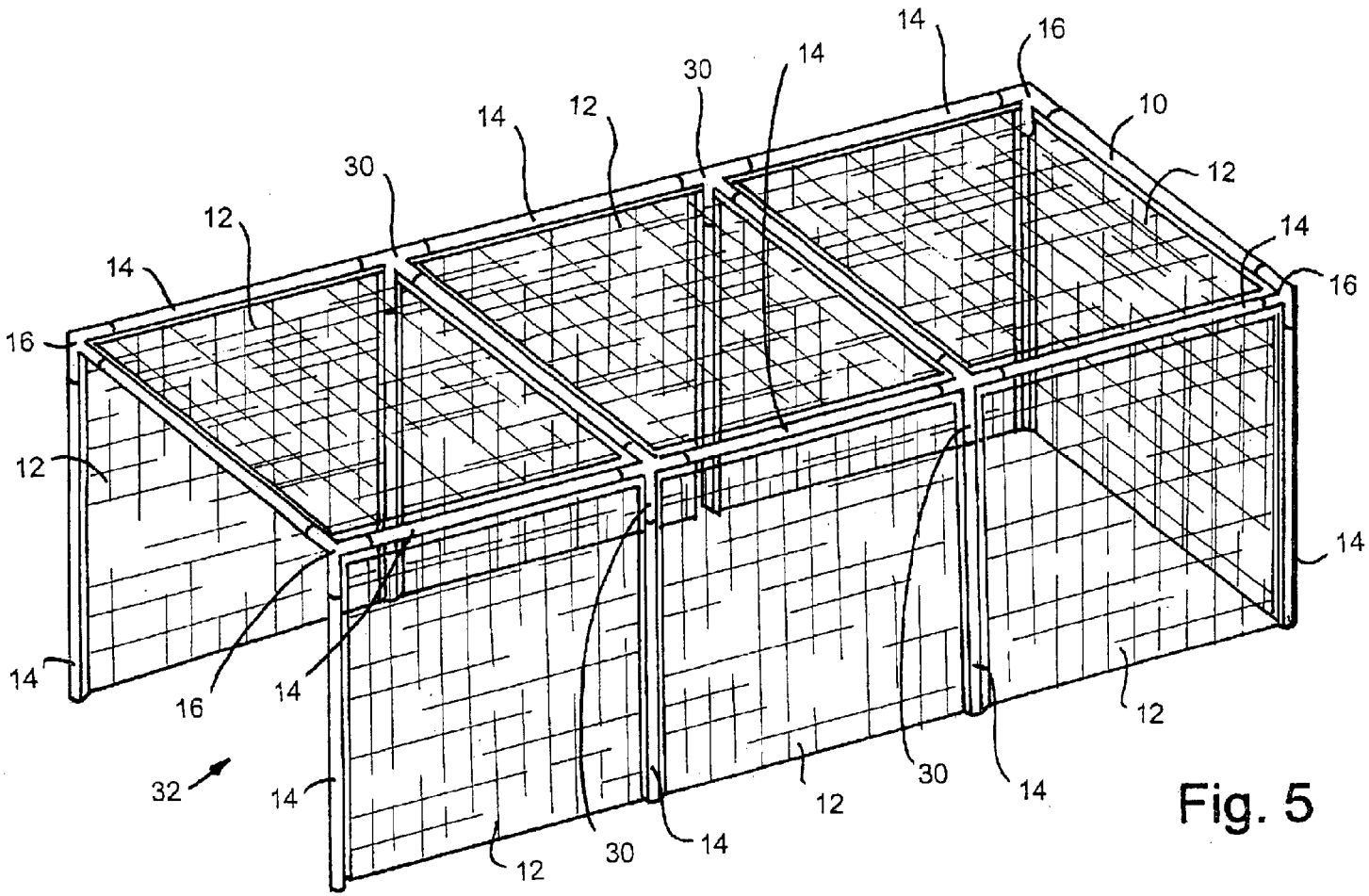
FIG. 5 is a perspective view of the all sports net of the present invention adapted to form a net tunnel, for example, as used in archery practice.

Alternatively, the netting panels 12, using exactly the same arrangement of tubular frames 10, could, with the exception of an end net assembly 1, be flexibly deployed to have two opposite sides open that, when combined with other net assemblies 1, can form extended nets or tunnels, as shown in FIG. 5. There, the only opening on the net assembly 1 is found at 32 and through which, for example, accuracy in throwing a football or in shooting at archery targets may be improved. It is further contemplated, for use with either netting panels 12 integrated into a netting prism 20 or as individual netting panels 12, that circular patterns or other indicia can be placed at the center of the netting panel 12 to serve as a target for accuracy practice.

Two additional embodiments of the upper corner unit 16 are shown in FIGS. 9 and 10. The corner unit 16 of FIG. 9 is generally the same as that in FIG. 7 and broadly comprises three orthogonally projecting pole receiving portions 18 extending in two horizontal and one vertical depending directions. However, also provided is a cross member bracing bar 40 welded to and extending between the horizontally extending pole receiving portions 18 for additional structural support and as an alternative location to which the tying straps 22 of the netting prism 20 or netting panels 12 can be attached to the tubular frame 10. Locking members 42, comprising a simple bolt-like fastener, are provided in place of the turnbuckles 34 and cooperating nut 38 welded to the outer surface of the pole receiving portion 18. Instead, the hole extending through the tubular pole receiving portion 18 is tapped for directly receiving the locking member 42 such that, when the end of one of the pole segment 14 is within the pole receiving portion 18, the locking member 42 is tightened to push against the intermediate pole segment 14 for a snug fit therein and locking the intermediate pole segment 14 into position.

The corner unit 16 of FIG. 10 is generally the same as that in FIG. 9, except that the locking members 42 are replaced with the turnbuckles 34 and cooperating nut 38. It should be noted that the turnbuckles 34 offer the additional advantage as to generally avoid the need for tools when assembling and disassembling the net assembly, in that they are more readily grasped and turned with the bare hand. However, it will be understood by those skilled in the art that retractable pin and corresponding opening attachment systems can be effectively applied to the pole receiving portions 18 of the present invention.

Figures 17, 18:
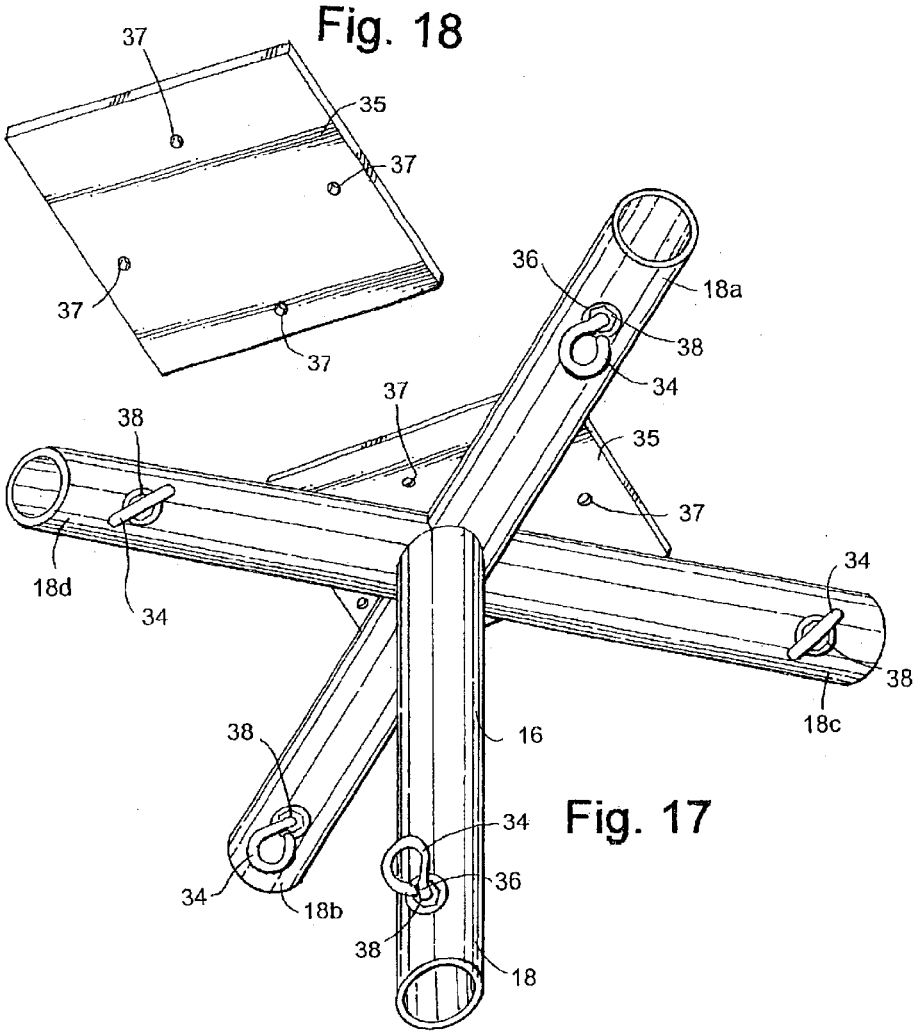
FIG. 17 is a perspective view of another embodiment of one of the corner units of the tubular frame of the present invention having orthogonally projecting pole receiving portions extending in a vertical and four horizontal directions, each of the pole receiving portions having locking turnbuckles, as well as a brace plate.
FIG. 18 is a perspective view of the brace plate for the corner unit of the tubular frame of the present invention.
Figure 19:
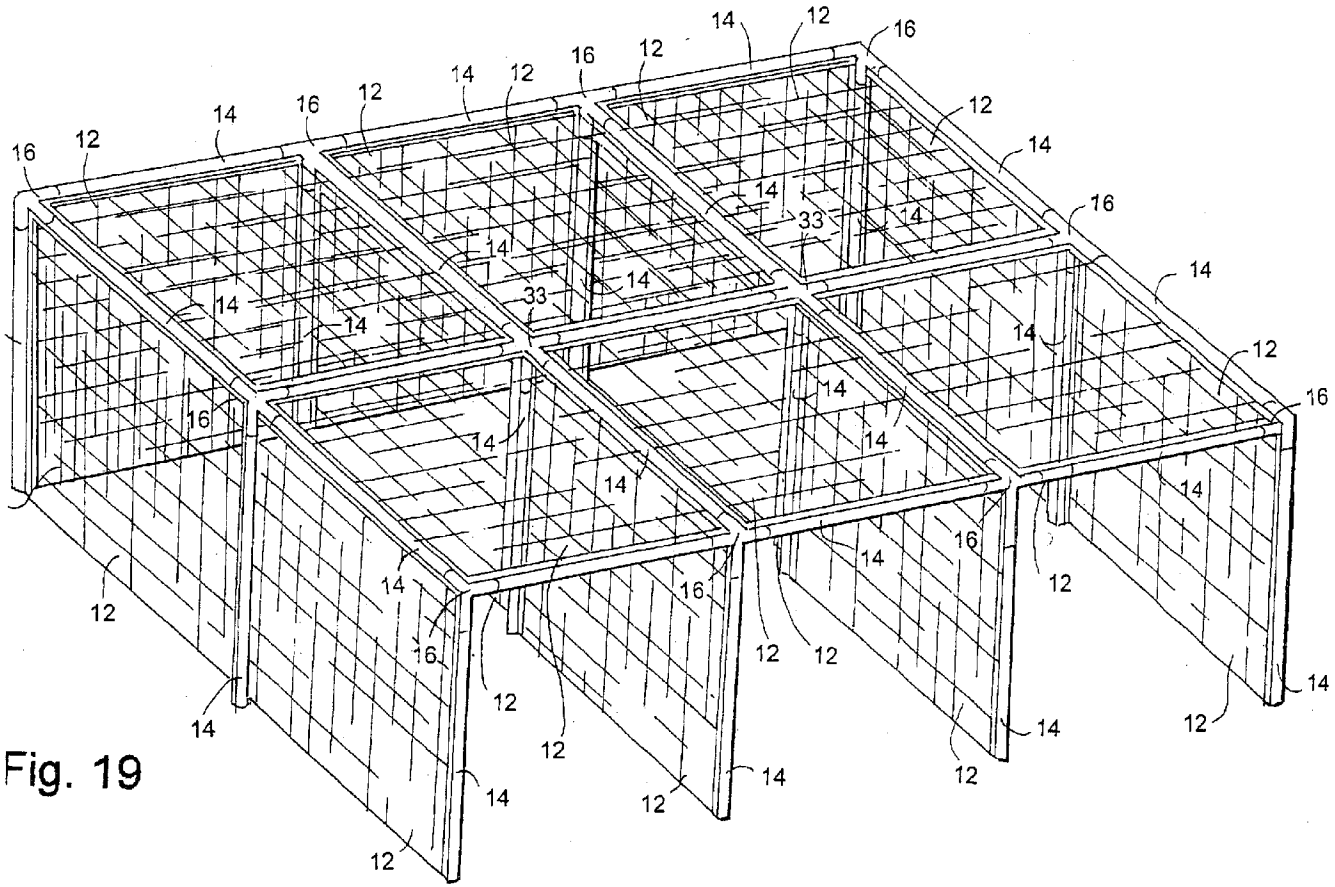
FIG. 19 is a perspective view of the modular all sports net of the present invention adapted to form a series of elongated individual net cages, for example, as used in archery practice.

Yet another embodiment of the upper corner unit 16 is shown in FIG. 17. There, the corner units 16 comprise the orthogonally projecting pole receiving portions 18 extending in two horizontal and one vertical depending directions, as well as fourth pole receiving portion 18*b* and fifth pole receiving portion 18*c*, extending in horizontal directions opposite that of one of the original horizontally extending pole receiving portions 18*a* and 18*d*, respectively, as best seen in FIG. 17. These additional pole receiving portions 18*b* and 18*c* allow the corner unit to be transformed into an intermediate upper unit 33, which, as seen assembled in FIG. 19, allows for extended and elongated sports net assemblies by receiving an additional intermediate pole segment 14 in the additional horizontally projecting pole receiving portion 18 to form an extended and elongated flat horizontal top plane, for example, a series of cages for archery.

The intermediate upper unit 33 may include a brace plate 35, best shown in FIG. 18, welded to the top of the horizontally extending pole receiving portions 18 for additional structural support, where openings 37 are provided to which the tying straps 22 of the netting prism 20 or netting panels 12 can be attached to the tubular frame 10.

Figure 20:
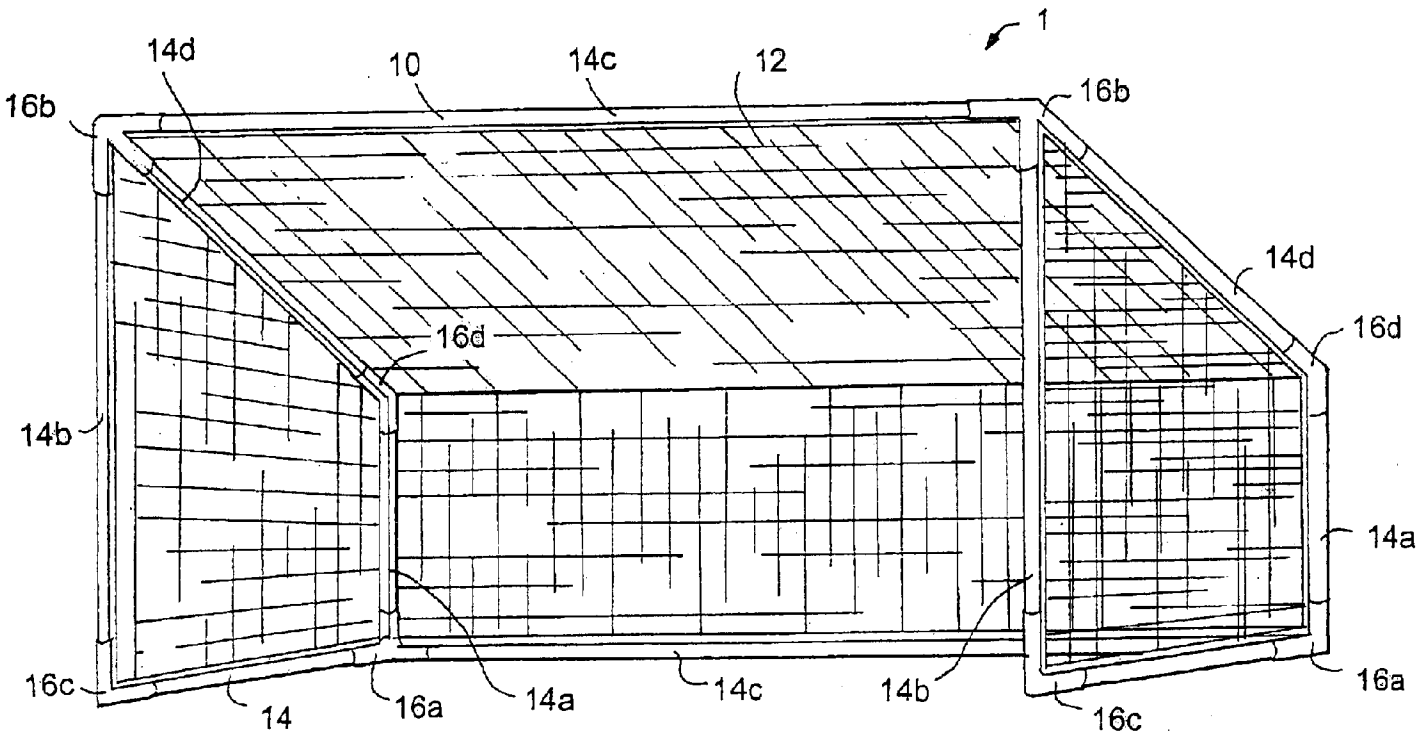
FIG. 20 is a perspective view of the modular all sports net of the present invention adapted to form a non-rectangular prism, for example, as used in soccer.

A further adaptation of the sports net assembly of the present invention is shown in FIG. 20, wherein there is shown in perspective view another modular all sports net assembly 1*a* according to the present invention. The modular all sports net assembly 1*a* again consists primarily of a tubular frame 10*a* and a plurality of netting panels 12, but the tubular frame 10*a* of the present invention forms the shape of an irregular prism, having trapazoidally-shaped polygon ends, as seen in FIG. 20. In this embodiment, the tubular frame 10*a* includes two shorter vertical tubular pole segments 14*a* at the rear and two longer vertical tubular pole segments 14*b* at the front, with two identical horizontal tubular pole segments 14*c* interconnecting the two side ends. An additional two inclined tubular pole segments 14*d* interconnect the front and rear of the tubular frame 10*a*. Each of the lower corner units 16*a* are similar to that applied to previous embodiments above, while a modified pair of upper corner units 16*b* may be provided with pole receiving portions 18 extending orthogonally in one horizontal and one vertical depending directions, as well as a downwardly inclined direction, as shown in FIG. 20, of less than 90°. A pair of lower and upper elbow portions 16*c* and 16*d*, respectively, each also having a pair of pole receiving portions 18, complete the tubular frame 10*a*. Each pole receiving portion 18 of the tubular frame 10*a* of FIG. 20 is adapted to receive one end of one of the intermediate pole segments 14 such that, when assembled, the modular all sports net assembly may adopt the form of a soccer net.

The netting 12 applicable to the modular all sports net assembly of the present invention may be formed from individual, discrete netting panels 12 attached to the tubular frame 10, forming an enclosure open on one side. Such a configuration would, for example, be especially useful in batting practice, where the players could line up in front of their respective cages or cubic net assemblies 1 created by the netting panels 12 and function substantially independently of, but simultaneously with, players standing in front of adjacent cubic net assemblies 1.

Figure 11:
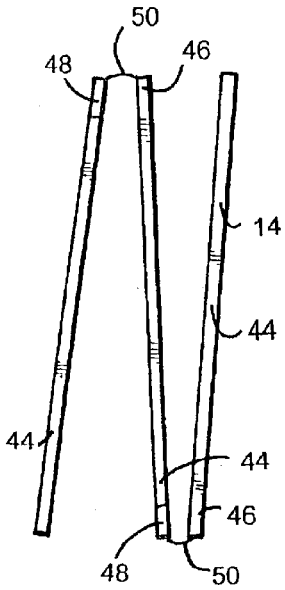
FIG. 11 is a plan view of one of the intermediate pole segments that is used to interconnect the corner units, in a folded condition.
Figure 12:
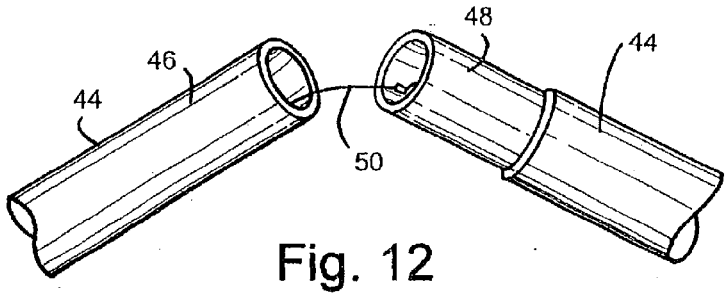
FIG. 12 is a close-up partial perspective view of one of the intermediate pole segments interconnecting the corner units showing the stretchable connecting cable visible in the folded condition.

An intermediate tubular pole segment 14 is shown in FIG. 11 and includes a plurality of (e.g., three for the regular prism tubular frame 10) articulating and interlocking portions 44 having mating ends 46 and 48, as shown in FIG. 12. Each of the pole segments 14 may be fabricated from 0.063 inches cold rolled steel tubing, or other materials, and provided at a length of three meters. However, longer or shorter lengths can be used with smaller or larger nets to obtain the benefits of the present invention. The interior diameter of mating end 46 is larger than the exterior diameter of mating end 48 and receives end 48 therein to positively connect the portions 44. A stretchable connecting cable 50 connects each portion 44 of the intermediate pole segments 14 to maintain the portions 44 attached one to the other and to keep the portions 44 of the pole segments 14 readily available.

Figure 13:
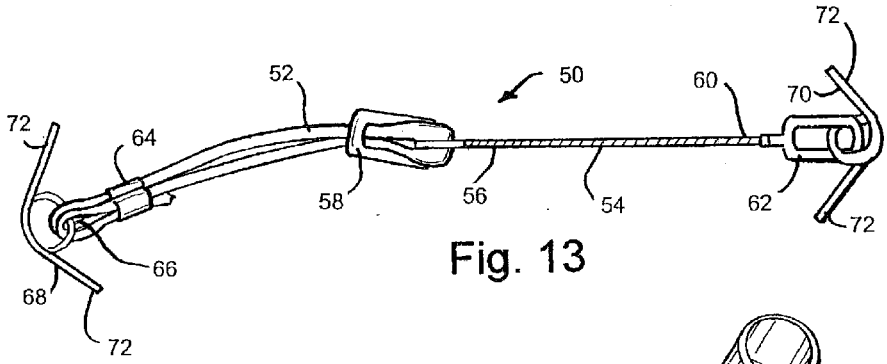
FIG. 13 is a plan view of the stretchable connecting cable for connecting one of the intermediate pole segments.

The stretchable connecting cable 50 is best seen in FIG. 13 and includes an elastomeric cord 52, also known as a shock cord, that is capable of stretching almost double its original length, attached to a braided stainless steel cable 54. A buckle 58 is attached at a first end 56 of the steel cable 54 by compression fit and a buckle 62 is similarly attached at a second end 60 of the steel cable 54. The elastomeric cord is looped through the buckle 58 and about itself to be fixedly and securely clamped via clamp 64 as shown, thereby forming loop 66 and becoming permanently attached to the steel cable 54. A looped wire segment 68 is secured through the loop 66 of the elastomeric cord 52 and an identical looped wire segment 70 is attached to the buckle 62 at the opposite end of the connecting cable 50.

Figure 14:
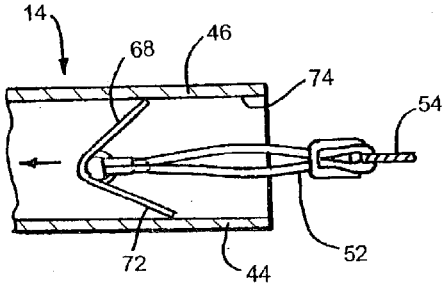
FIG. 14 is a cross-sectional view of one end portion of one of the intermediate pole segments for interconnecting the corner units.

Each of the wire segments 68 and 70 may be provided with tangs 72, which, as shown in FIG. 14, are inserted into one of the open mating ends 46 or 48 of the intermediate tubular pole segment 14 with the other in the opposite open mating end 48 or 46. The looped wire segment 68 is pushed into the open mating end 46 or 48 a sufficient distance so that the elastomeric cord 52 is not exposed, leaving only the steel cable 54 to be seen. The looped wire segment 70 is similarly pushed into the opposite mating end 46 or 48, but is not inserted as far. However, it is desirable that each of the looped wire segments be inserted sufficiently so that the elastomeric cord 52 is stretched a bit to either assemble or disassemble the intermediate pole segments 14. The tangs 72, by virtue of the fact that they extend outwardly in excess of the interior diameter 74 of the mating ends 46 and 48 when uncompressed, exert significant force against the interior diameter 74 of the portions 44 and thereby lock the connecting cable 50 firmly in position, regardless of the force exerted on the connecting cable 50 when stretched.

As can be seen in FIG. 12, the result is a connecting cable 50 where only the steel wire cable 54 is exposed. This is an improvement over the prior art shock cords, where rubbing against the open mating ends 46 and 48 of the pole portions 44 has been found to cause abrading and undesirable failures. Moreover, the connecting cable 50, with only the steel cable exposed, is more resistant to cutting and failure from other sharp objects. Thus, as shown, the mating ends 46 and 48 are readily available for manipulation and assembly/disassembly.

Figure 16:
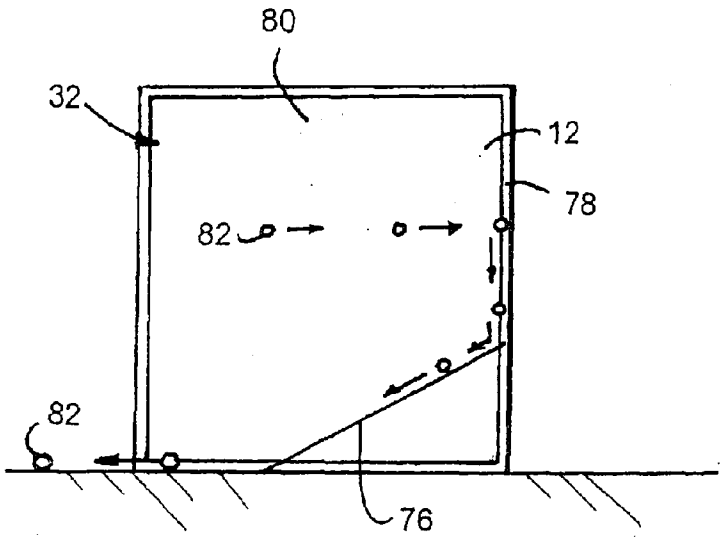
FIG. 16 is a cross-sectional view taken along the line 16—16 of FIG. 15 of the modular all sports net of the present invention adapted to include a ball return.
Figure 15:
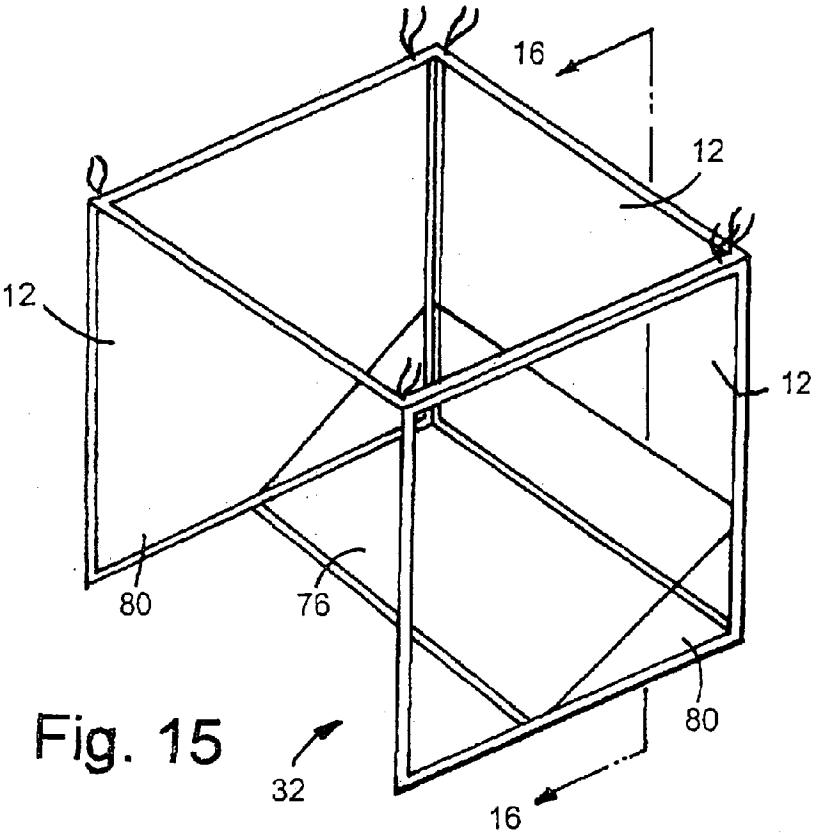
FIG. 15 is a perspective view of the modular all sports net of the present invention adapted to include a ball return.

As a further refinement to the instant invention, the netting panels can be provided with a detachable ball return feature, as seen in FIGS. 15 and 16. This feature is added to the embodiment where the netting panels 12 are joined about their edge peripheries to form an integral regular netting prism 20, as is shown. However, this feature can also be used with individual netting panels 12 discussed above. The detachable ball return generally comprises an inclined panel 76, also may be formed of a mesh-type netting fabric made from any natural or synthetic fiber, such as nylon, attached to a rear wall 78 and to each side walls 80 of the prism 20. The attachment means for attaching the inclined panel 76 to the netting prism 20 may be a detachable series of hooks that engage the mesh of the netting panels 12, allowing the net to be used for other purposes, such as soccer. However, if preferred, the inclined panel 76 can be sown into place.

As shown in FIG. 16, the ball return feature is obtained largely through the force of gravity. The ball 82 is shown in the air as it approaches the rear wall 78. When the ball 82 encounters the rear wall 78, its kinetic energy is dissipated and the ball 82 begins to fall toward the ground and inclined panel 76. Upon encountering the inclined panel 76, the ball 82 is redirected toward the opening 32 of the net assembly 1 and thus returned out of the net assembly 1.

The steps required to set up the modular all sports net assembly 1 of the present invention are straightforward and easily accomplished by a single person. The portions 44 of the pole segments 14 are aligned one to the other and mating ends 48 are inserted into mating end 46, where the connecting cable 50 causes the portions 44 to form the assembled pole segment 14. This assembly is maintained in position through the residual tension remaining in the connecting cable 50. The ends of each of four horizontal pole segments 14 are inserted into each of the horizontal pole receiving portions 18 of the upper corner units 16 to form a horizontal plane, with the turnbuckle 34 or locking members 42 being used to lock the pole segments 14 into place. An end of each of the remaining four pole segments 14 is similarly inserted into and locked within each of the vertically depending receiving portions 18 of the upper corner units 16 to form the side vertical planes. Thus, the tubular frame 10 is easily and readily assembled. The netting panels 12 are then attached to the frame 10 in the desired configuration through the tying straps 22 and lower attachment means 24. Once assembled, tether lines can be attached to further anchor the net assembly 1. Disassembly is simply the reverse process.

Figures 21A, 21B, 21C, 21D:
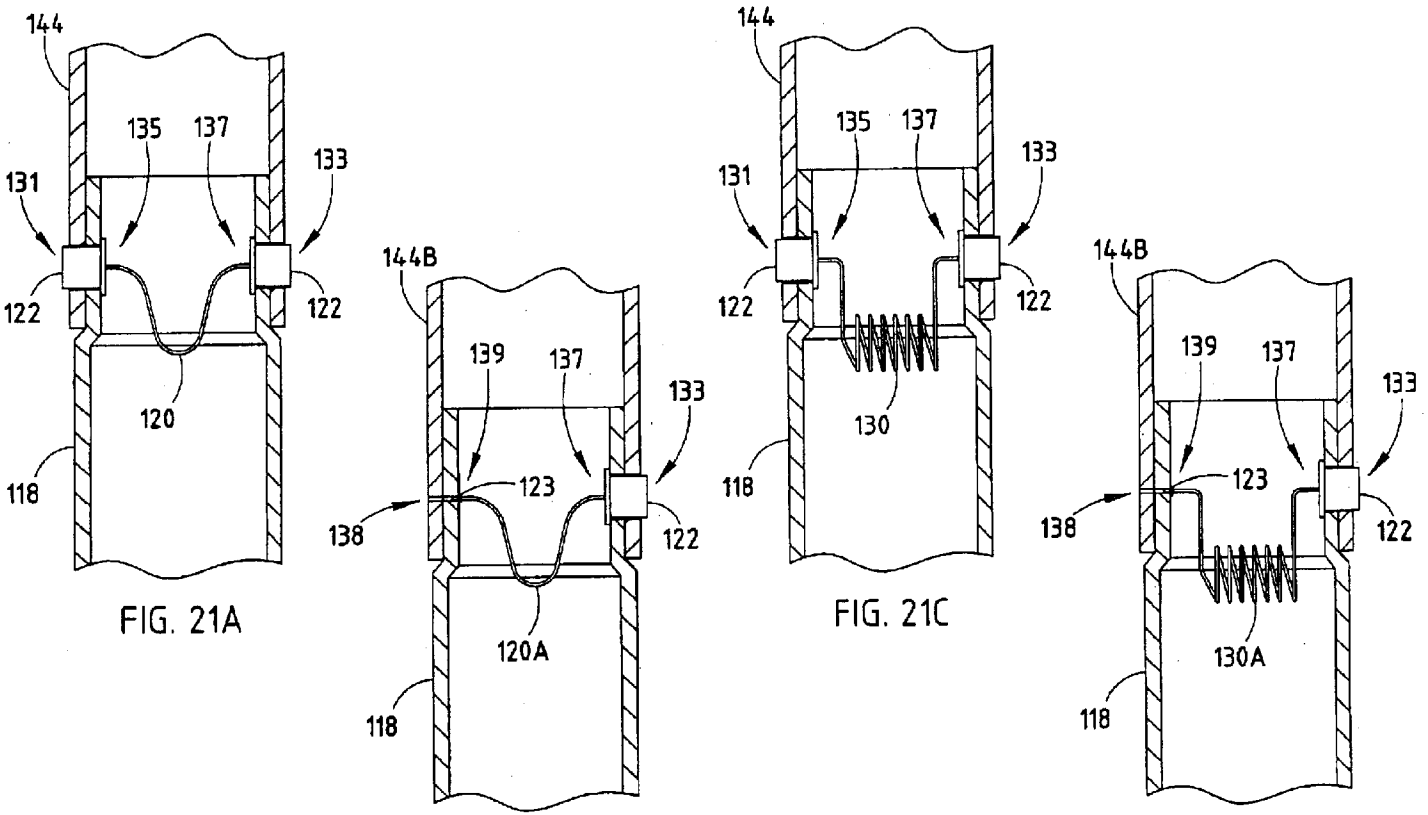
FIGS. 21A–21D depict wire segments including one or more buttons installed within at least one portion of an intermediate tubular pole segment or a projecting pole receiving portion of a corner unit.

With reference to FIG. 21A, according to another embodiment of the present invention, a wire segment 120, including buttons 122 connected at opposite ends of the wire segment 120, is positioned within a projecting pole receiving portion 118 of a corner unit. The projecting pole receiving portion 118 includes apertures 135 and 137, which receive the buttons 122. An intermediate tubular pole segment 144 is interlocked with the projecting pole receiving portion 118 when an end portion of the intermediate tubular pole segment 144, which includes apertures 131 and 133, is slid over the projecting pole receiving portion 118 and the buttons 122. When positioned appropriately, the buttons 122 extend through the apertures 131 and 133, thus, interlocking the projecting pole receiving portion 118 and the intermediate tubular pole segment 144.

FIG. 21B depicts another wire segment 120A that is formed according to another embodiment of the present invention. As is shown in FIG. 21B, one end of the wire segment 120A includes a button 122 and an opposite end 123 of the wire segment 120A is shaped to be received in an aperture 139, formed in the projecting pole receiving portion 118. As is depicted in FIG. 21B, the end 123 of the wire segment 120A does not extend completely through to the outer surface of the projecting pole receiving portion 118. As is also shown in FIG. 21B, the intermediate tubular pole segment 144 includes an aperture 138 that is approximately sized such that a tool can be inserted into the aperture 138, through the aperture 139, to force the end 123 of the wire segment. 120A out of the aperture 139 for removal from the assembly. It should be appreciated that the wire segments 120 and 120A are readily removable from the projecting pole receiving portion 118 should the need arise for replacement of the wire segments 120 and 120A. It should also be appreciated that the wire segments 120 and 120A may be positioned within the intermediate tubular pole segment 144, instead of within the projecting pole receiving portion 118.

With reference to FIG. 21C, a wire segment 130, which is similar to wire segment 120, includes coils between the buttons 122. The coils tend to prolong the life of the wire segment 130. Similarly, FIG. 21D discloses a wire segment 130A that is essentially the same as the wire segment 120A, with the exception that the wire segment 130A includes a coil between the button 122 and the second end 123. Similar to the wire segments 120 and 120A, the wire segments 130 and 130A interlock an intermediate pole segment with a projecting pole receiving portion of a corner unit.

Figure 22A:
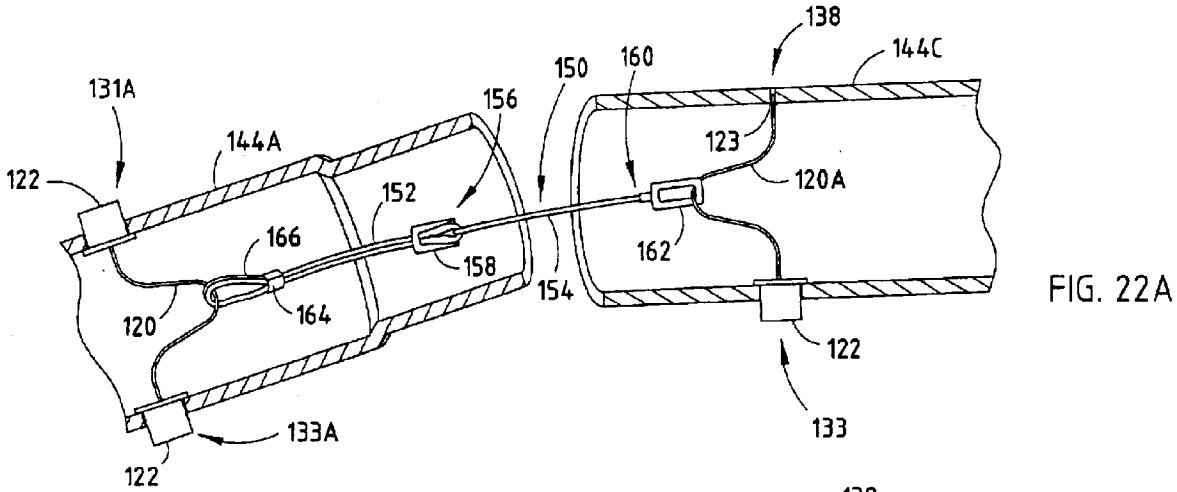
FIGS. 22A–22B depict wire segments with one or more buttons utilized to attach a connecting cable within two intermediate tubular pole segments.

FIG. 22A depicts a side view of a connecting cable 150 that includes wire segments 120 and 120A at opposite ends thereof. The cable 150 includes an elastomeric cord 152 that is coupled to the wire segment 120, via a loop 166 and a clamp 164. The elastomeric cord 152 is coupled to cable 154 with a buckle 158. An opposite end of the cable 154 includes a bracket 162 that is coupled to the wire segment 120A. The buttons 122, which are located at opposite ends of the wire segment 120, extend through apertures 131A and 133A formed in the intermediate tubular pole segment 144A. The intermediate tubular pole segment 144C includes an aperture 138 for receiving the end 123 of the wire segment 120A and an aperture 133 for receiving a button 122.

Figure 22B:
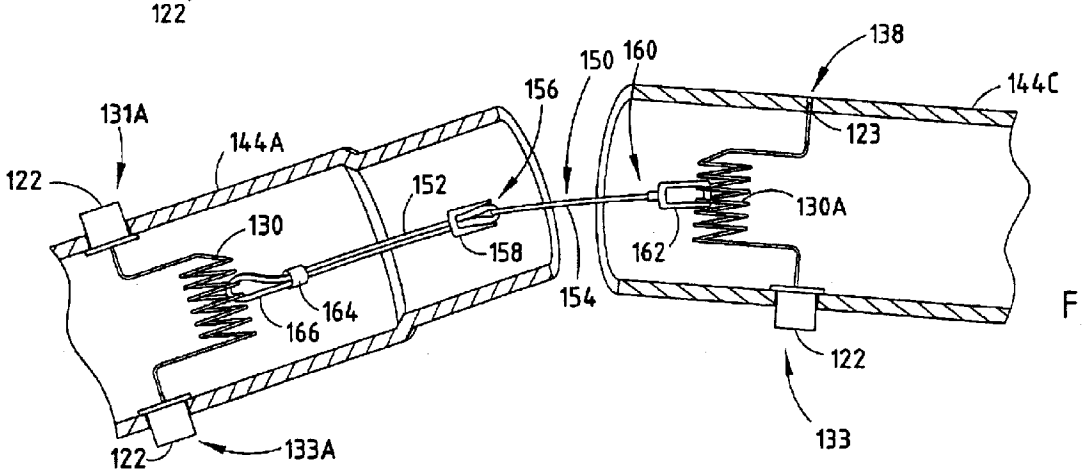

FIG. 22B depicts a cross-sectional view of two intermediate tubular pole segments 144A and 144C joined by a connecting cable 150 and wire segments 130 and 130A. As previously discussed, the coils in the wire segments 130 and 130A tend to prolong the life of the wire segments. It should be appreciated that multiple intermediate tubular pole segments may be joined by the connecting cable 150 by extending the length of the cable 154 to extend through multiple intermediate tubular pole segments. Further, it should be appreciated that the connecting cable 150 of FIGS. 22A and 22B may be utilized in conjunction with corner units and intermediate tubular pole segments. An advantage of the embodiments discussed with respect to FIGS. 21A–21D and 22A–22B is that the button and/or buttons allow for ready replacement of the wire segments should the wire segments and/or the cable become damaged. Further, when the button extends through apertures in two engaged intermediate tubular pole segments, the pole segments are interlocked.

The embodiments of the invention have thus been attained in an economical, practical and facile manner. While various embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A modular sports net assembly of the type forming an enclosure and used for receiving and retaining a sports item, such as a ball or the like, wherein the assembly is assembled for deployment as a prism of varying shapes and sizes on any relatively flat ground surface and disassembled for storage, the assembly comprising:

a tubular interfitting frame having the shape of a polyhedron having two polygon sides in parallel planes and two sides formed in the shape of parallelograms formed from a plurality of intermediate tubular pole segments, at least a portion of the intermediate tubular pole segments interconnecting a plurality of corner units to form a plurality of orthogonal edge peripheries, the corner units including projecting pole receiving portions extending along at least three independent axes, each pole receiving portion receiving an end of the at least a portion of the intermediate tubular pole segments, wherein the frame defines at least three interconnected planes; and a plurality of planar netting panels removably attached to one of the edge peripheries of the frame so as to enclose the frame, except for at least one side plane when the frame assembled is deployed on the relatively flat ground surface, wherein the at least a portion of the intermediate tubular pole segments interconnecting the plurality of corner units comprise a plurality of articulating and interlocking portions having cooperating first and second mating ends, where an interior diameter of the first mating end is larger than an exterior diameter of the second mating end and receives the second mating end therein to positively connect the articulating and interlocking portions, and wherein a stretchable connecting cable interconnects at least two of the articulating and interlocking portions of the at least a portion of the intermediate tubular pole segments, the connecting cable including a first wire segment at each end thereof, the first wire segments including buttons located at opposite ends and positioned within two different ones of the articulating and interlocking portions, where the buttons protrude through apertures in the two different ones of the articulating and interlocking portions to positively connect the at least two of the articulating and interlocking portions together.

2. The assembly of claim 1, wherein the shape of the frame is a cube.

3. The assembly of claim 1, wherein the shape of the frame is an irregular prism and one of the projecting pole receiving portions of at least two of the corner units extends at an angle of less than 90° relative another of the projecting pole receiving portions.

4. The assembly of claim 1, wherein the netting panels further include fasteners at each upper corner of the netting panels for ready attachment and detachment of the upper corners of the netting panels to the edge peripheries of the frame.

5. The assembly of claim 1, wherein each of the projecting pole receiving portions includes apertures for receiving buttons connected at opposite ends of a second wire segment that is positioned within one of the projecting pole receiving portions of each of the corner units and the end of an intermediate tubular pole segment for interlocking the corner unit to the end of one of the intermediate tubular pole segments.

6. The assembly of claim 5, wherein at least a portion of the second wire segment includes a coil section for providing spring action.

7. The assembly of claim 1, wherein the corner units comprise orthogonally projecting pole receiving portions extending in four horizontal and one vertical depending directions, two of the horizontally extending receiving portions extending in directions opposite one from another and the other two of the horizontally extending receiving portions extending in directions opposite one from another, the corner units being capable of receiving four horizontal intermediate tubular pole segments, whereby the corner is adapted to be used as an intermediate upper unit for forming an extended flat horizontal top plane.

8. The assembly of claim 1, wherein the connecting cable comprises an elastomeric cord and a steel cable, the elastomeric cord being fixedly attached at a first end to a first end of the steel cable with one of the first wire segments secured to a second opposite end of the elastomeric cord and another of the first wire segments attached to a second opposite end of the steel cable, and wherein each of the second ends of the elastomeric cord and the steel cable are secured to one of the first or second mating ends of the intermediate tubular pole segment with the other of the second ends of the elastomeric cord and the steel cable secured to the opposite of the first or second mating end, where the first wire segments are positioned in the first and second mating ends so that the elastomeric cord is not exposed.

9. The assembly of claim 8, wherein the connecting cable, when installed in the intermediate tubular pole segments, is stretched from an initial position to either assemble or disassemble the intermediate tubular pole segments.

10. The assembly of claim 1, wherein the intermediate tubular pole segments are the same length and form a regular square prism.

11. A modular sports net assembly of the type forming an enclosure and used for receiving and retaining a sports item, such as a ball or the like, wherein the assembly is assembled for deployment as a prism of varying shapes and sizes on any relatively flat ground surface and disassembled for storage, the assembly comprising:

a tubular interfitting frame having the shape of a polyhedron having two polygon sides in parallel planes and two sides formed in the shape of parallelograms formed from a plurality of intermediate tubular pole segments, at least a portion of the intermediate tubular pole segments interconnecting a plurality of corner units to form a plurality of orthogonal edge peripheries, the corner units including projecting pole receiving portions extending along at least three independent axes, each pole receiving portion receiving an end of the at least a portion of the intermediate tubular pole segments, wherein the frame defines at least three interconnected planes; and a plurality of planar netting panels removably attached to one of the edge peripheries of the frame so as to enclose the frame, except for at least one side plane when the frame assembled is deployed on the relatively flat ground surface, wherein the at least a portion of the intermediate tubular pole segments interconnecting the plurality of corner units comprise a plurality of articulating and interlocking portions having cooperating first and second mating ends, where an interior diameter of the first mating end is larger than an exterior diameter of the second mating end and receives the second mating end therein to positively connect the articulating and interlocking portions, and wherein a stretchable connecting cable interconnects at least two of the articulating and interlocking portions of the at least a portion of the intermediate tubular pole segments, where each of the projecting pole receiving portions includes apertures for receiving buttons connected at opposite ends of a second wire segment and positioned within one of the projecting pole receiving portions of each of the corner units and the end of an intermediate tubular pole segment for interlocking the corner unit to the end of one of the intermediate tubular pole segments.

12. The assembly of claim 11, wherein the shape of the frame is a cube.

13. The assembly of claim 11, wherein the shape of the frame is an irregular prism and one of the projecting pole receiving portions of at least two of the corner units extends at an angle of less than 90° relative another of the projecting pole receiving portions.

14. The assembly of claim 11, wherein the netting panels further include fasteners at each upper corner of the netting panels for ready attachment and detachment of the upper corners of the netting panels to the edge peripheries of the frame.

15. The assembly of claim 11, wherein the connecting cable includes a first wire segment at each end thereof, the first wire segments including buttons located at opposite ends and positioned within two different ones of the articulating and interlocking portions, where the buttons protrude through apertures in the two different ones of the articulating and interlocking portions to positively connect the at least two of the articulating and interlocking portions together.

16. The assembly of claim 15, wherein at least a portion of the first wire segment includes a coil section for providing spring action.

17. The assembly of claim 11, wherein the corner units comprise orthogonally projecting pole receiving portions extending in four horizontal and one vertical depending directions, two of the horizontally extending receiving portions extending in directions opposite one from another and the other two of the horizontally extending receiving portions extending in directions opposite one from another, the corner units being capable of receiving four horizontal intermediate tubular pole segments, whereby the corner is adapted to be used as an intermediate upper unit for forming an extended flat horizontal top plane.

18. The assembly of claim 11, wherein the connecting cable comprises an elastomeric cord and a steel cable, the elastomeric cord being fixedly attached at a first end to a first end of the steel cable with one of the first wire segments secured to a second opposite end of the elastomeric cord and another of the first wire segments is attached to a second opposite end of the steel cable, and wherein each of the second ends of the elastomeric cord and the steel cable are secured to one of the first or second mating ends of the intermediate tubular pole segments with the other of the second ends of the elastomeric cord and the steel cable secured to the opposite of the first or second mating end, where the first wire segments are positioned in the first and second mating ends so that the elastomeric cord is not exposed.

19. The assembly of claim 18, wherein the connecting cable, when installed in the intermediate tubular pole segments, is stretched from an initial position to either assemble or disassemble the intermediate tubular pole segments.

20. The assembly of claim 11, wherein the intermediate tubular pole segments are the same length and form a regular square prism.

21. A modular sports net assembly of the type forming an enclosure and used for receiving and retaining a sports item, such as a ball or the like, the assembly comprising:

a tubular interfitting frame having the shape of a polyhedron having two polygon sides in parallel planes and two sides formed in the shape of parallelograms formed from a plurality of intermediate tubular pole segments, at least a portion of the intermediate tubular pole segments interconnecting a plurality of corner units to form a plurality of orthogonal edge peripheries, the corner units including projecting pole receiving portions extending along at least three independent axes, each pole receiving portion receiving an end of the at least a portion of the intermediate tubular pole segments, wherein the frame defines at least three interconnected planes; and a plurality of panels removably attached to one of the edge peripheries of the frame so as to enclose the frame except for at least one side plane when the frame assembled is deployed on a relatively flat ground surface, wherein the at least a portion of the intermediate tubular pole segments interconnecting the plurality of corner units comprise a plurality of articulating and interlocking portions having cooperating first and second mating ends, where an interior diameter of the first mating end is larger than an exterior diameter of the second mating end and receives the second mating end therein to positively connect the articulating and interlocking portions, and wherein a stretchable connecting cable interconnects at least two of the articulating and interlocking portions of the at least a portion of the intermediate tubular pole segments, the connecting cable including a first wire segment at each end thereof, each of the first wire segments including at least one button located at a first end of the first wire segment and positioned within two different ones of the articulating and interlocking portions, where the at least one button protrudes through apertures in the two different ones of the articulating and interlocking portions to positively connect the at least two of the articulating and interlocking portions together, and where a second end of each of the wire segments is shaped to engage and be removably connected with one of the at least two of the articulating and interlocking portions.

22. The assembly of claim 21, wherein each of the projecting pole receiving portions includes at least one aperture for receiving at least one button connected at a first end of a second wire segment and positioned within one of the projecting pole receiving portions of each of the corner units and the end of an intermediate tubular pole segment for interlocking the corner unit to the end of one of the intermediate tubular pole segments.

23. The assembly of claim 22, wherein at least a portion of the wire segment includes a coil section for providing spring action.

24. The assembly of claim 21, wherein the connecting cable comprises an elastomeric cord and a steel cable, the elastomeric cord being fixedly attached at a first end to a first end of the steel cable with one of the first wire segments secured to a second opposite end of the elastomeric cord and another one of the first wire segments attached to a second opposite end of the steel cable, wherein each of the second ends of the elastomeric cord and the steel cable are secured to one of the first or second mating ends of the intermediate tubular pole segment with the other of the second ends of the elastomeric cord and the steel cable secured to the opposite of the first or second mating end, where the first wire segments are positioned in the first and second mating ends so that the elastomeric cord is not exposed.

25. The assembly of claim 24, wherein the connecting cable, when installed in the intermediate tubular pole segments, is stretched from an initial position to either assemble or disassemble the intermediate tubular pole segments.

* * * * *

UNITED STATES PATENT AND TRADEMARK OFFICE

CERTIFICATE OF CORRECTION

PATENT NO. : 6,966,852 B2
DATED : November 22, 2005
INVENTOR(S) : Yoon

It is certified that error appears in the above-identified patent and that said Letters Patent is hereby corrected as shown below:

Column 11,
Line 32, after "segment" delete ".".

Signed and Sealed this

Twenty-fifth Day of April, 2006

JON W. DUDAS
*Director of the United States Patent and Trademark Office*